US007325583B2

(12) United States Patent
Watanabe

(10) Patent No.: US 7,325,583 B2
(45) Date of Patent: Feb. 5, 2008

(54) COATING FILM TRANSFER TOOL

(75) Inventor: Kazuya Watanabe, Osaka (JP)

(73) Assignee: Fujicopian Co., Ltd., Osaka (JP)

( * ) Notice: Subject to any disclaimer, the term of this patent is extended or adjusted under 35 U.S.C. 154(b) by 334 days.

(21) Appl. No.: 11/255,561

(22) Filed: Oct. 21, 2005

(65) Prior Publication Data

US 2006/0090857 A1 May 4, 2006

(30) Foreign Application Priority Data

Nov. 1, 2004 (JP) ..... 2004-318077

(51) Int. Cl.
*B32B 37/22* (2006.01)

(52) U.S. Cl. ..... 156/527; 156/577; 242/160.4; 242/588.6; 118/76; 118/200; 118/257; 206/411

(58) Field of Classification Search ..... 156/523, 156/527, 538, 540, 574, 577, 579; 118/76, 118/200, 257; 225/46; 242/160.2, 160.4, 242/170, 171, 588, 588.2, 588.3, 588.6; 206/411
See application file for complete search history.

(56) References Cited

U.S. PATENT DOCUMENTS 7,204,287 B2 * 4/2007 Casaldi et al. ..... 156/523

FOREIGN PATENT DOCUMENTS

JP 11-227386 8/1999
JP 2001-19914 1/2001
JP 2002-264588 9/2002

OTHER PUBLICATIONS

Abstract of JP2002264588, Inventor: Shimizu Hideo, Applicant: Tombow Pencil, Application No: JP200172720 200010314.

Abstract of JP2001019914, Inventor: Koyama Satoshi et al., Applicant: Pilot KK, Application No. JP19990193787 19990707.

* cited by examiner

*Primary Examiner*—Mark A Osele
(74) *Attorney, Agent, or Firm*—Howson & Howson LLP

(57) ABSTRACT

In a coating film transfer tool, a tape supply core rotation limiter predetermines the amount of coating film laid down on a receiving surface, to enable erasure of small areas. The permitted rotation of the supply core can be selected from a group of different choices by the use of an adjusting member, releasably engageable with the teeth of a toothed wheel rotatable with the supply core, and movable with the wheel when engaged therewith until engaged with a stop. A spring pawl, engageable with the teeth of the wheel, prevents reverse rotation of the supply core. The adjusting member can be disabled by holding it out of engagement with the toothed wheel, so that the instrument can be used as a conventional coating film transfer tool.

20 Claims, 4 Drawing Sheets

COATING FILM TRANSFER TOOL

FIELD OF THE INVENTION

This invention relates to coating film transfer tools for transferring correction films, adhesives, decorative coating films, or the like, onto a receiving surface.

BACKGROUND OF THE INVENTION

A conventional coating film transfer tool comprises a supply core and a take-up core, both rotatably supported within a case having a transfer head. A coating film on a base tape is supplied as a winding on the supply core. The base tape is unwound from the supply core, passes over the transfer head, and is wound onto the take-up core as the transfer head moves over a receiving surface. As the transfer head move over the receiving surface, the coating film is transferred from the base tape onto the receiving surface A coating film transfer tool functions efficiently when erasing relatively long sections of print, for example, a section containing more than ten letters. However, when a small section of written matter, consisting of only one or a few letters is to be erased, it is difficult to adjust the length of the transfer tape to the length of the section to be erased. Consequently, the coating film is commonly transferred to an area that does not need to be erased, or the length of the transferred film is insufficient to cover section to be erased. In such case, it is necessary to remove, or add, coating film, and excessive time is consumed in effecting erasure of the unwanted written matter.

Unexamined Japanese Patent Publications Nos. 264588/2002, 227386/1999, and 19914/2001 disclose stamp-type coating film transfer tools, which transfer a coating film onto a receiving surface by pressing a transfer head downwards to correct a single letter or a small, well-defined area. The coating film transfer tools disclosed in Japanese patent publications 227386/1999, and 19914/2001 not only transfer the coating film onto the receiving surface by pressing, but also transfer the coating film by moving the tool parallel to the receiving surface as in the case of a conventional coating tape transfer tool. The stamp-type pressing transfer tool can securely erase letters within a fixed area, since the width of the transfer head corresponds to that of a coating film transfer surface.

Because the stamp-type pressing transfer tool has a large transfer surface area, it is difficult to apply pressing force evenly over the receiving surface, and it is difficult, and often impossible, to achieve fine transfer resolution. In addition, since the transfer head is in the shape of a box, corresponding to the size of the transfer surface which transfers the coating film onto the receiving surface, it is difficult to check whether the transfer head is over the targeted letters or area until the transfer head is pressed down onto the receiving surface. Moreover, when using a stamp-typed pressing transfer tool as a conventional transfer tool, which transfers a coating film by moving parallel to a receiving surface, it is difficult to cut the coating film cleanly by raising the transfer head, because of the large cohesive forces acting on the coating film. As a result, the coating film can be dragged to an area of the receiving surface to which the transfer head was not applied. In order to avoid undesired dragging of the coating film, it is necessary to control the breaking strength and elongation rate of the coating film, as disclosed, for example in Japanese patent publication 19914/2001. However, controlling the breaking strength and elongation rate of a coating film leads to manufacturing complications and excessive manufacturing cost.

An object of this invention is to provide a coating film transfer tool in which a coating film is transferred by pressing the transfer head onto a receiving surface and moving the tool parallel to the receiving surface, and which is capable of erasing written matter over a predetermined distance, and which is capable of erasing very small sections of written matter easily and securely.

SUMMARY OF THE INVENTION

The coating film transfer tool in accordance with the invention, comprises a rotatable tape supply core, a transfer head, and a rotatable take-up core. A transfer tape, comprising a base tape and a coating film, is wound on the supply core. The base tape extends from the supply core, past the transfer head, to the take-up core, for transfer of the coating film from the base tape to a receiving surface as the transfer tape is unwound from the supply core and pressed by the transfer head against the receiving surface while the transfer head is moved parallel to the receiving surface. The improvement comprises a tape supply length limiter for limiting the rotation of the supply core, and thereby predetermining the amount of base tape that moves past the transfer head in a single coating film transfer operation.

Preferably, the tape supply length limiter is adjustable to allow selection from a set of different, and preferably discrete, choices, the predetermined amount of base tape that moves past the transfer head in a single coating film transfer operation.

In a preferred embodiment, the tape supply length limiter comprises a toothed wheel, rotatable with the supply core, an adjusting member releasably engageable with the teeth of the wheel, and movable with the wheel when engaged therewith, and a stop engageable by the adjusting member.

To avoid inadvertent unreeling of the tape from the supply core as the supply length limiter is reset, a means, such as a spring pawl having both sloping and non-sloping tooth faces engageable with the teeth of the wheel, is provided for preventing reverse rotation of the supply core in a direction opposite to the direction in which the core rotates as transfer tape is unwound therefrom.

A mechanism is preferably provided for disabling the operation of the tape supply length limiter so that the instrument can be used as a conventional coating film transfer tool.

The coating film transfer tool according to the invention makes it possible to transfer a coating film to a pinpointed area by presetting the range of rotation of the transfer tape supply core and forcing the supply core to stop at a predetermined position in order to prevent more than a predetermined length of coating film from being applied to a receiving surface in a given coating film transfer operation. With a preferred embodiment of the transfer tool in accordance with the invention, it is also possible to select the predetermined amount of coating film to be applied from a set of choices. The invention allows the amount of coating film applied to a receiving surface to be accurately controlled, making it possible to erase small amounts of written matter, such as one or two printed letters, without erasing adjacent written matter.

DETAILED DESCRIPTION OF THE PREFERRED EMBODIMENTS

Figure 1:
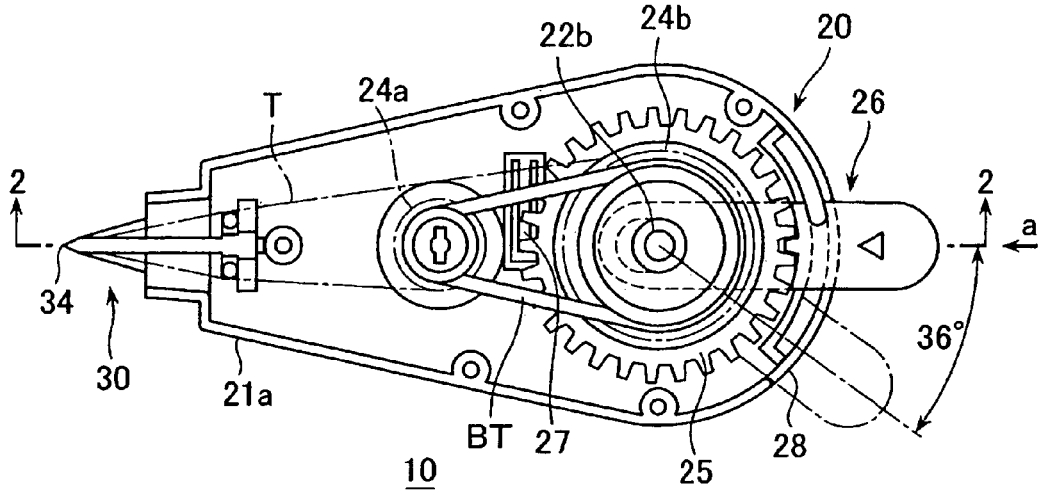
FIG. 1 is a side elevational view of a coating film transfer tool according to the invention, with the cover removed to reveal the internal mechanism of the transfer tool.
Figure 2:
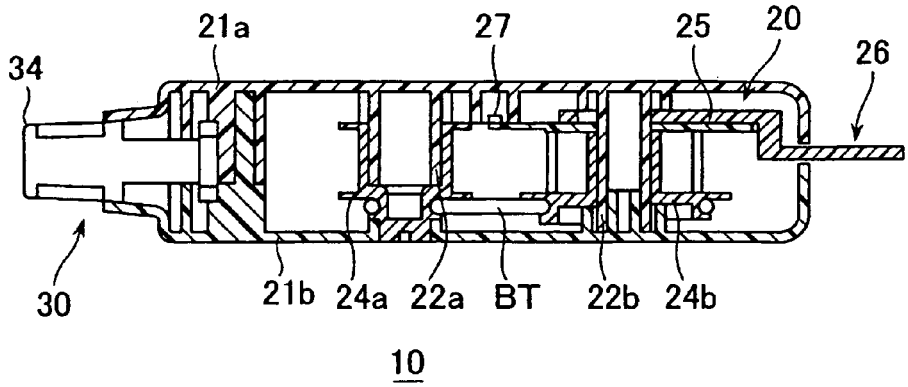
FIG. 2 is a cross sectional view taken on section plane 2-2 of FIG. 1.

As shown in FIGS. 1 and 2, the coating film transfer tool 10 according to the invention comprises a case 21*a*, having shafts 22*a* and 22*b*, a transfer head 30 at the end of the case, the transfer head having a transfer tip 34, a supply core 24*b* and a take-up core 24*a* which are rotatably supported by shafts 22*a* and 22*b* respectively, and a transfer tape T comprising a coating film on a base tape. The coating film transfer tool 10 also includes a tape supply length adjusting mechanism 20.

The supply core 24*b* and the take-up core 24*a* are connected by an endless rubber belt BT. The belt drives the take-up core, with some slippage, when the supply core rotates as transfer tape T is pulled from the supply core. In the operation of the transfer tool, the transfer tape T is drawn off the supply core. The coating film is separated from the base tape at the transfer tip 34, where the coating film is transferred onto a receiving surface. The base tape, from which the coating film has been separated, is wound onto the take-up core 24*a*.

The tape supply adjusting mechanism 20 allows a predetermined length of transfer tape to be supplied, by adjustably limiting the range of rotation of the supply core 24*b*, causing the supply core to stop at a predetermined position. The tape supply length adjusting mechanism 20 comprises a toothed wheel 25, which rotates with the supply core 24*b*, a tape supply length adjusting member 26 engageable with the toothed wheel 25, and an opening 28 in the case 21*a* through which the adjusting member 26 extends. One end of the opening 28 (the upper end in FIGS. 1 and 3, engages the adjusting member 26 to limit its range of movement, thereby limiting rotation of the tape supply core 25*b*.

Figure 4:
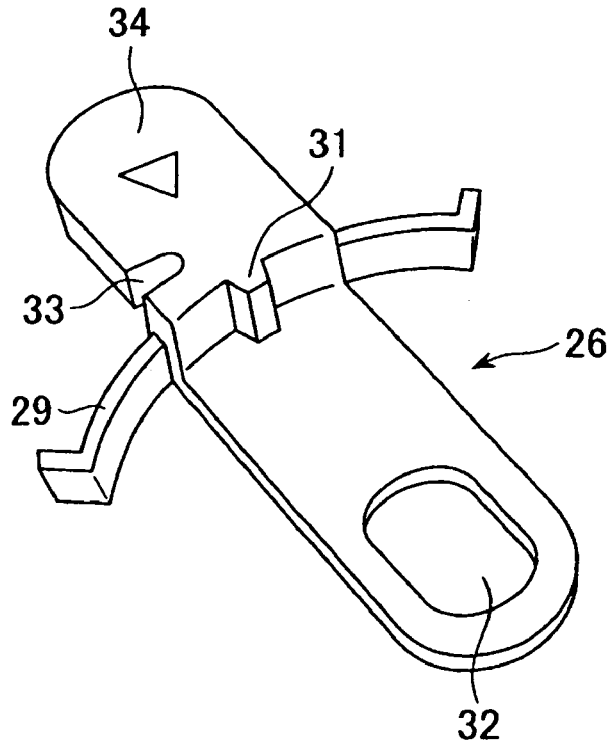
FIG. 4 is perspective view of the tape supply length adjusting mechanism.

As seen in FIG. 4, the adjusting member 26 includes an arc-shaped spring 29 is provided on the adjusting member 26 at a location approximately midway between its inner and outer ends. The spring engages an inner wall of the case 21*b*, urging the adjusting member inward toward the toothed wheel 25. A projection 31, which enters a space between adjacent teeth of wheel 25, is provided on the adjusting member 26 adjacent the center of spring 29. An elongated hole 32 is provided in the adjusting member near its inner end, and a U-shaped groove 33 is provided in the side of a flat gripping section 34 at the outer end of the adjusting member for, so that the user can grasp and pull the adjusting member, and thereby disengage the projection 31 from the toothed wheel 25.

As shown in FIGS. 1 and 2, the shaft 22*b* on the case extends through the elongated hole 32 of the adjusting member 26, thereby supporting the adjusting member while allowing rotation of the adjusting member about the axis of the toothed wheel, and also allowing longitudinal movement of the adjusting member for disengagement of its projection 31 from the teeth of wheel 25. The adjusting member rotates with the toothed wheel when its projection 31 is engaged with the toothed wheel, and can be rotated independently of the toothed wheel, when, by pulling on gripping section 34, the user disengages projection 31 from the toothed wheel, against the action of spring 29. In each case, however, the ends of opening 28 establish limits for the rotation of the adjusting member.

Figure 5:
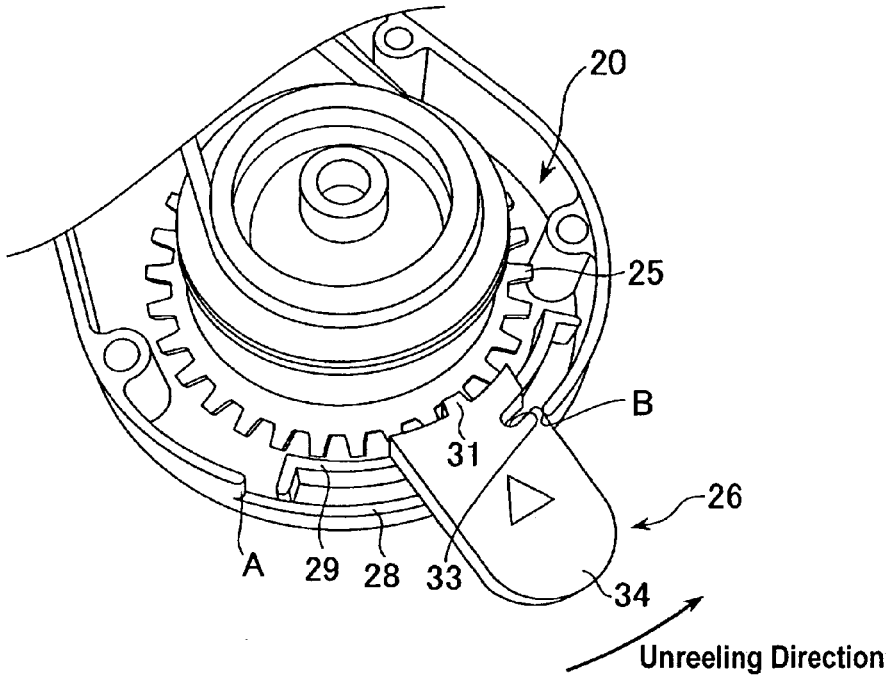
FIG. 5 is an enlarged, fragmentary, perspective view showing the components in the vicinity of the tape supply length adjusting mechanism.

As shown in FIG. 5, the adjusting member 26 can move between a starting point A and an ending point B at the respective ends of opening 28. In FIG. 5, the adjusting member 26 is in contact with the ending point B, and projection 31 is in contact with the teeth of toothed wheel 25. When the adjusting member is in contact with ending point B as shown, the transfer tape can no longer be unreeled from the supply core.

The adjusting member 26 may be pulled manually to disengage its projection 31 from the toothed wheel 25. The adjusting member 26 may then be rotated clockwise, and its projection 31 re-engaged with the toothed wheel 25 at an appropriate position between the starting point A and the ending point B. Then, when the coating film transfer tool 10 is pressed onto, and moved over a receiving surface, the toothed wheel 25 and the adjusting member 26 rotate with the supply core in the direction of the arrow in FIG. 5 until the adjusting member once again contacts point B at an end of opening 28. When the adjusting member 26 reaches the ending point B, rotation of the supply core 24*b* is stopped, and consequently, the feed of transfer tape T is also stopped.

Figure 3:
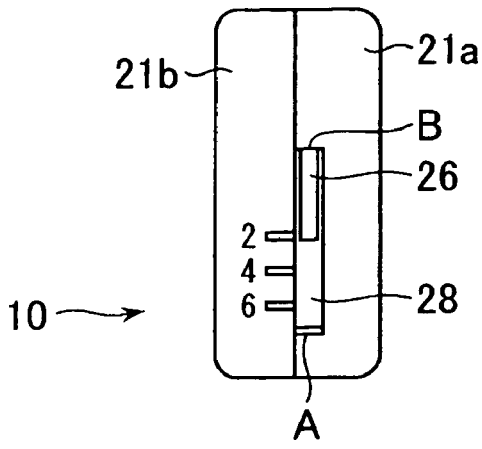
FIG. 3 is right side elevational view of the tool, as seen along the direction indicated by arrow a in FIG. 1.

The amount of transfer tape to be supplied can be adjusted by aligning a triangular marking on the adjusting member 26 (see FIG. 4) with one of the markings adjacent opening 28, as shown in FIG. 3. In this case, the markings "2", "4" and "6" indicate the length, in millimeters, of transfer tape T that will be fed. The distance between the markings on the scale correspond to the pitch of the teeth of the toothed wheel 25. Thus, if the projection of the adjusting member is re-engaged with the toothed wheel at scale position "2", the adjusting member 26 will allow the supply core 24*b* to rotate through an angle of 12 degrees, supplying approximately 2 mm of tape until the adjusting member 26 contacts ending point B to stop the rotation of the supply core. The length of tape supplied will vary depending on the amount of tape wound on the supply core. However, the diameter of the supply core and the diameter of the outer winding of tape on the core differ by only a small amount, and therefore variations in the length of tape supplied for a given setting of the adjusting member are inconsequential. The scales shown in FIG. 3 are merely examples, and it is possible to provide for smaller or larger feed lengths by providing a toothed wheel having a suitable pitch and changing the scales on the case accordingly.

Figure 6:
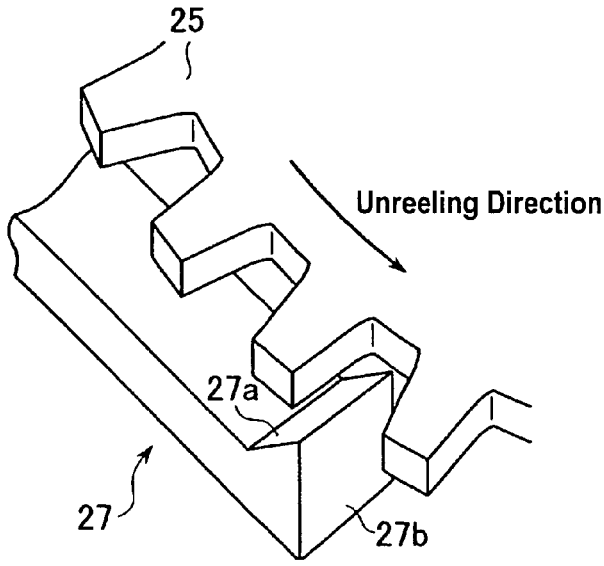
FIG. 6 is an enlarged, fragmentary, perspective view showing details of an anti-reverse member.

To prevent the toothed wheel from being rotated in the reverse direction when the adjusting member is pulled outward and moved clockwise to adjust the length of the transfer tape to be supplied, an anti-reverse pawl 27 is provided, as shown in FIG. 6. The anti-reverse pawl 27 comprises a flat spring, having a tooth at one end, the tooth having a sloping face 27*a* and a non-sloping face 27*b*. When the toothed wheel 25 rotates in the direction to feed tape toward the transfer head, the teeth of wheel 25 push against the sloping face 27*a* of the tooth, and the pawl is elastically deformed so that the teeth of wheel 25 can move over the sloping face of tooth 27*a*. On the other hand, if an attempt is made to rotate the toothed wheel in the reverse direction, engagement of a tooth of the wheel with the non-sloping surface 27*b* of the pawl tooth, will prevent reverse rotation. Ratchets, and other suitable anti-reverse mechanisms can, of course, be used as alternatives to the anti-reverse pawl mechanism shown in FIG. 6.

Figure 7:
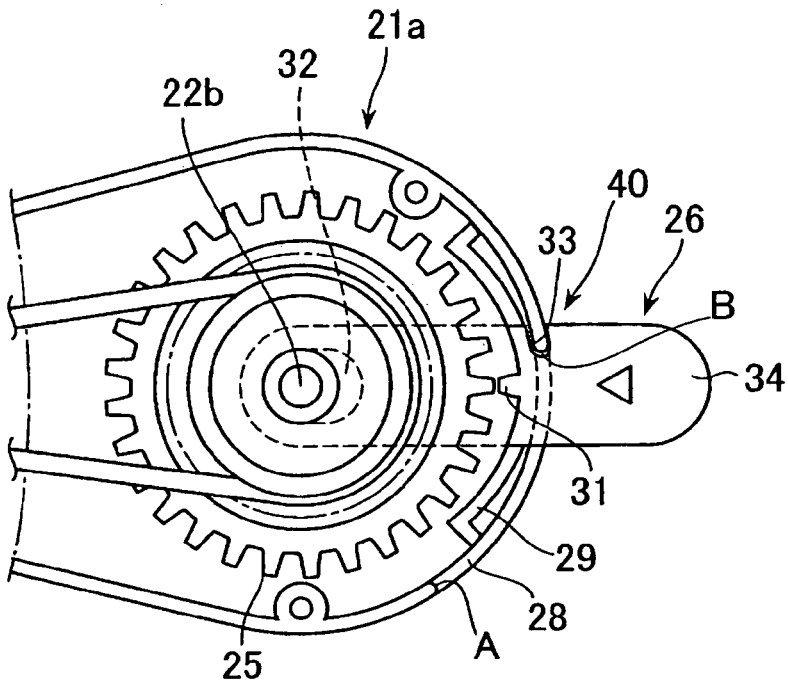
FIG. 7 is a partial plan view showing the tape supply length adjusting mechanism in its released condition.

In FIG. 7, the tape supply length adjusting mechanism is taken out of service by a disabling mechanism 40. The flat section 34 of the adjusting member 26 may be grasped manually, pulled against the force exerted by spring 29 to disengage the projection 31 from the teeth of wheel 25, and then the adjusting member may be rotated counterclockwise about the axis of the toothed wheel and supply core so that the U-shaped groove 33 is engaged with the ending point B of opening 28. When the U-shaped groove is engaged with the ending point B of the opening 28, the projection 31 will remain disengaged from the toothed wheel, and the instrument can be used as an ordinary coating film transfer tool, in which the transfer tape T is supplied continuously. The elastic deformation of the spring 29 maintains the U-shaped groove 33 engaged with the ending point B of the opening 28.

The invention enables a coating film transfer tool, of the kind having a relatively sharp transfer tip which moves parallel to a receiving surface, to erase small areas, for example, one or two letters of print, reliably and without difficulty. In addition, since the tape supply length adjusting mechanism can be easily disabled, the transfer tape can be supplied continuously as in the case of a conventional coating film transfer tool.

What is claimed is:

1. A coating film transfer tool, comprising a rotatable tape supply core, a transfer head, a rotatable take-up core, and a transfer tape, comprising a base tape and a coating film, wound on the supply core, the base tape extending from the supply core, past the transfer head, to the take-up core, for transfer of the coating film from the base tape to a receiving surface as the transfer tape is unwound from said supply core and pressed by the transfer head against said receiving surface while the transfer head is moved parallel to said receiving surface, wherein the improvement comprises a tape supply length limiter for limiting the rotation of the supply core, and thereby predetermining the amount of base tape that moves past the transfer head in a single coating film transfer operation.

2. A coating film transfer tool as claimed in claim 1, in which the tape supply length limiter is adjustable to select, from a set of different choices, the predetermined amount of base tape that moves past the transfer head in a single coating film transfer operation.

3. A coating film transfer tool as claimed in claim 1, in which the tape supply length limiter is adjustable to select, from a set of different discrete values, the predetermined amount of base tape that moves past the transfer head in a single coating film transfer operation.

4. A coating film transfer tool as claimed in claim 1, wherein said tape supply length limiter comprises a toothed wheel, rotatable with said supply core, an adjusting member releasably engageable with the teeth of said toothed wheel, and movable with said toothed wheel when engaged therewith, and a stop engageable by said adjusting member.

5. A coating film transfer tool as claimed in claim 2, wherein said tape supply length limiter comprises a toothed wheel, rotatable with said supply core, an adjusting member releasably engageable with the teeth of said toothed wheel, and movable with said toothed wheel when engaged therewith, and a stop engageable by said adjusting member.

6. A coating film transfer tool as claimed in claim 3, wherein said tape supply length limiter comprises a toothed wheel, rotatable with said supply core, an adjusting member releasably engageable with the teeth of said toothed wheel, and movable with said toothed wheel when engaged therewith, and a stop engageable by said adjusting member.

7. A coating film transfer tool as claimed in claim 1, having means for preventing reverse rotation of said supply core in a direction opposite to the direction in which said supply core rotates as transfer tape is unwound therefrom.

8. A coating film transfer tool as claimed in claim 2, having means for preventing reverse rotation of said supply core in a direction opposite to the direction in which said supply core rotates as transfer tape is unwound therefrom.

9. A coating film transfer tool as claimed in claim 3, having means for preventing reverse rotation of said supply core in a direction opposite to the direction in which said supply core rotates as transfer tape is unwound therefrom.

10. A coating film transfer tool as claimed in claim 4, having means for preventing reverse rotation of said supply core in a direction opposite to the direction in which said supply core rotates as transfer tape is unwound therefrom.

11. A coating film transfer tool as claimed in claim 1, including a mechanism for disabling the operation of said tape supply length limiter.

12. A coating film transfer tool as claimed in claim 2, including a mechanism for disabling the operation of said tape supply length limiter.

13. A coating film transfer tool as claimed in claim 3, including a mechanism for disabling the operation of said tape supply length limiter.

14. A coating film transfer tool as claimed in claim 4, including a mechanism for disabling the operation of said tape supply length limiter.

15. A coating film transfer tool as claimed in claim 5, including a mechanism for disabling the operation of said tape supply length limiter.

16. A coating film transfer tool as claimed in claim 6, including a mechanism for disabling the operation of said tape supply length limiter.

17. A coating film transfer tool as claimed in claim 7, including a mechanism for disabling the operation of said tape supply length limiter.

18. A coating film transfer tool as claimed in claim 8, including a mechanism for disabling the operation of said tape supply length limiter.

19. A coating film transfer tool as claimed in claim 9, including a mechanism for disabling the operation of said tape supply length limiter.

20. A coating film transfer tool as claimed in claim 10, including a mechanism for disabling the operation of said tape supply length limiter.

* * * * *